US005303517A

United States Patent [19]

Schneider

[11] Patent Number: 5,303,517

[45] Date of Patent: Apr. 19, 1994

[54] MODULAR STORMWATER GUTTER SYSTEM

[76] Inventor: Darwin R. Schneider, 1319 Orange Tree Dr., Edgewater, Fla. 32132

[21] Appl. No.: 974,848

[22] Filed: Nov. 10, 1992

[51] Int. Cl.[5] ..... E04D 13/00
[52] U.S. Cl. ..... 52/11; 52/16
[58] Field of Search ..... 52/11, 13, 16; 248/48.1, 48.2

[56] References Cited

U.S. PATENT DOCUMENTS

| | | | |
|---|---|---|---|
| 2,111,251 | 3/1938 | Spilsbury | 52/11 X |
| 3,670,505 | 1/1972 | Weaver | 61/14 |
| 3,821,512 | 6/1974 | Stanford | 219/200 |
| 4,043,527 | 8/1977 | Franzmeir | 248/65 |
| 4,632,342 | 12/1986 | Skinner | 52/11 X |
| 4,741,131 | 5/1988 | Parker | 52/11 X |
| 4,769,526 | 11/1988 | Taouil | 219/213 |
| 4,901,954 | 2/1990 | Fairgrieve et al. | 52/11 X |
| 4,910,926 | 3/1990 | Paulsson | 52/11 |
| 4,912,888 | 4/1990 | Martin | 52/11 X |
| 4,951,430 | 8/1990 | Gottlieb | 52/11 |
| 4,956,948 | 9/1990 | Hart | 52/11 X |
| 4,998,386 | 3/1991 | Baumgarth | 52/11 X |

FOREIGN PATENT DOCUMENTS

| | | | |
|---|---|---|---|
| 31474 | 12/1976 | Australia | 52/11 |
| 68429 | 6/1978 | Japan | 52/11 |
| 28447 | 2/1991 | Japan | 52/11 |
| 1125825 | 9/1968 | United Kingdom | 52/16 |
| 2233383 | 1/1991 | United Kingdom | 52/11 |

*Primary Examiner*—Peter M. Cuomo
*Assistant Examiner*—Jerry Redman

[57] ABSTRACT

An interior roof gutter system intended for use on certain large non-residential buildings on which stormwater flows to low elevation perimeter walls. Whereas such walls frequently present a vertically extended parapet, the present invention discloses a novel interior gutter system. The gutter system is preferably composed of fiberglass reinforced polyester, or similar material. The gutter system is comprised of a plurality of rigid independent, elongated, trough-like, monolithic modules. When installed in tandem, with a non-impinged connection, expansion and contraction forces are accommodated. The present invention provides for attachment and flashing to the parapet wall on one of the elongated module walls, and attachment and flashing under the roof membrane on the opposite module wall. To prevent ice formation from blocking normal drainage in freezing climates, a melting device is presented.

9 Claims, 3 Drawing Sheets

MODULAR STORMWATER GUTTER SYSTEM

BACKGROUND—FIELD OF INVENTION

This invention relates to rain gutters, specifically to rain gutters which are used on certain large non-residential building roofs.

BACKGROUND—DESCRIPTION OF PRIOR ART

It is a common condition that on certain large non-residential buildings, exterior perimeter walls are extended vertically beyond the elevation of the eaves to create a parapet. Furthermore, it is obvious that the parapet prohibits normal shedding of stormwater to beyond the outside of the building. It is, therefore, necessary to incorporate an interior gutter and leader system. Under the harsh environment that this condition presents, inherent problems become commonplace, such as gutter material deterioration, buckling and sagging, as well as gutter connection failures resulting from expansion and contraction forces. A further problem is impeded drainage, as attributed to ice blockage in freezing climates, which is of particular concern since an interior gutter is a critically important component of the roof system.

Accordingly, much prior art has been addressed to these conditions, such as the need to accommodate axial stress induced by thermal changes, as taught by Weaver U.S. Pat. No. 3,670,505 (1972), whereby a flexible vinyl connector provides compensation to alleviate these stress loads. The need to maintain water tight integrity within dynamic connectors is subject to potential material fatigue and subsequent leaks.

The need of deterring the upward migration of rainwater under the roof membrane, as taught by Taouil U.S. Pat. No. 4,769,526 (1988), wherein raised ribs act to prevent under-roof water intrusion. This disclosure is not entirely satisfactory, in as much as the ribs act to elevate and separate the roof membrane from the panel. Therefore, without benefit of a full mechanical bond between the panel and the roof membrane, the roof is subjected to potential wind lift forces.

Much prior art has been dedicated to preventing the blockage of normal liquid flow resulting from ice formation in the body of the gutter in freezing climates. It is disclosed by Stanford U.S. Pat. No. 3,821,512 (1974), that a multiple component end product of some complexity is taught. This presents need for a higher degree of skilled in-the-field fabrication and assembly, than otherwise desirable. Franzmeir U.S. Pat. No. 4,043,527 (1977) discloses a deicing system that is encumbered by external electrical conduit, hangers and various brackets. The presence of this extraneous hardware presents the potential for accumulating debris, thereby impeding the free flow of the watershed.

OBJECTS AND ADVANTAGES

A principal object of the present invention is to provide a stormwater gutter system for use on large non-residential buildings that will not rust, corrode, or oxidize.

Additionally, several objects and advantages of the present invention are:

To provide a gutter system comprising a plurality of elongated, trough-like modules, whereby each module is an independent, seamless, monolithic vessel. The requirement for extraordinary in-the-field assembly or fabrication, as well as the need for hanger brackets, braces or connection hardware is obviated.

To provide a gutter system that will positively drain stormwater and eliminate ponding. This objective is attained by a gutter floor angle of incline to drain ports.

To provide a gutter which will not flood in the event of heavy rain loads or blocked leaders thereby providing emergency flooding relief means to said roof gutter assembly. This objective is attained by the provision of an overflow positioned at the substantially centered mid-point between drain port apertures, exterior gutter wall.

To provide a gutter system which overcomes the stresses of thermal-shock-induced expansion and contraction. This objective is attained by disclosing multiple, independent gutter modules. Each independent module has expansion and contraction co-efficiencies that alleviate buckling and shrinking.

To provide a gutter system which is capable of preventing ice formation in freezing climates. This objective is attained with the provision of an electrically energized melting device.

To provide a gutter system which assures structural integrity, durability and longevity. This objective is attained by the preferable use of fiberglass reinforced polyester in its composition.

To provide a gutter system that is practical and economical to manufacture. This objective is attained by utilizing presently existing facilities, commonly available materials, and current technology.

To provide a gutter system that is convenient to store and ship. This objective is attained by a flared configuration that accommodates partial nesting of the gutter modules within one another.

Further objects and advantages are to provide a gutter system that is easily, quickly, and efficiently adaptable to all roof framing methods and materials, without need for modification.

My invention further describes a gutter system that is comprised of a plurality of ready-to-use monolithic modules, which obviates the need for any extraordinary fabrication or assembly skills relative to the in-the-field installation. Still further objects and advantages will become known from a consideration of the ensuing description and drawings.

BRIEF DESCRIPTION OF THE DRAWINGS

Preferred embodiments of the invention are shown in the accompanying drawings of which.

Figure 1:
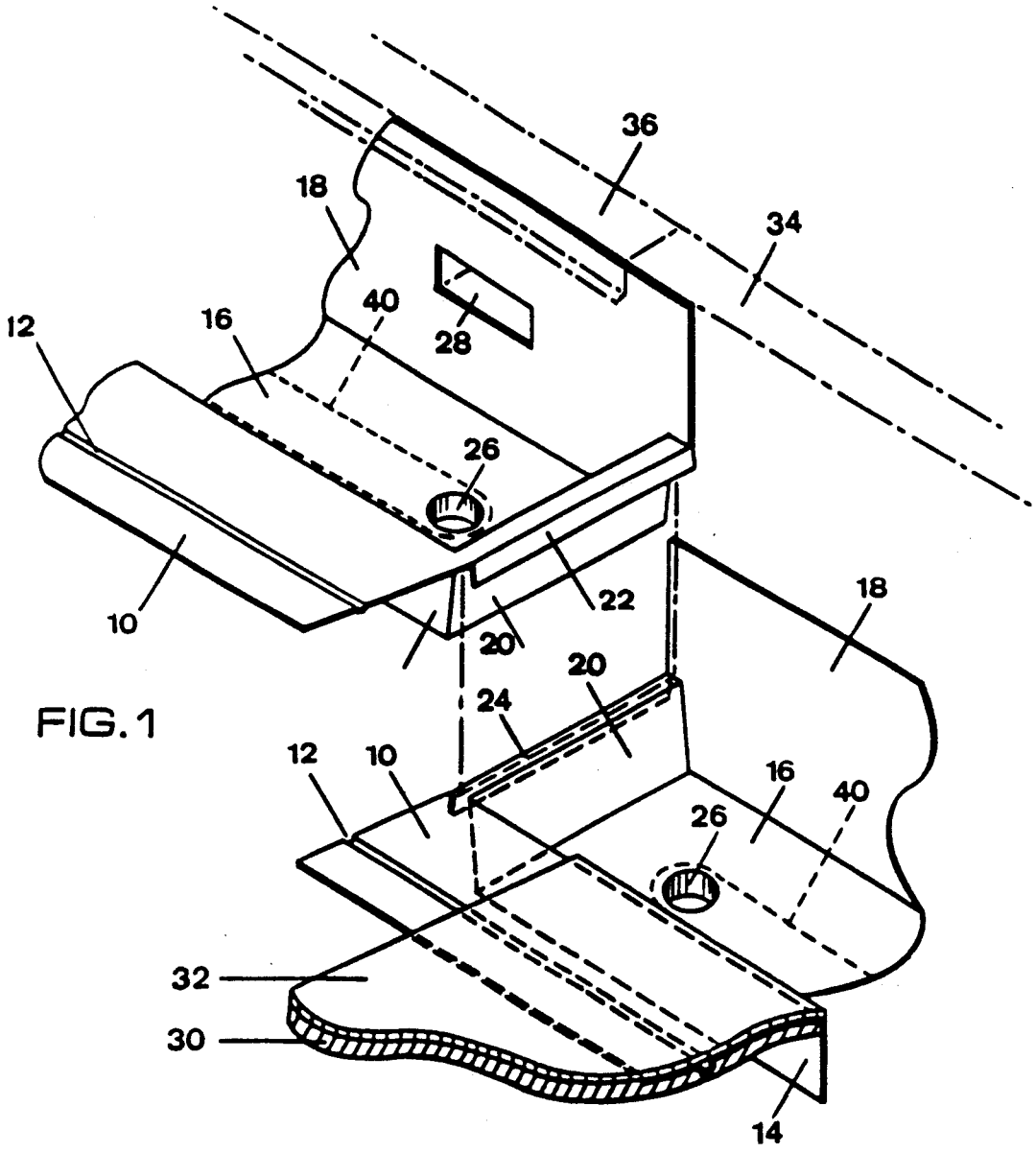
FIG. 1 is a perspective view showing portions of the gutter, the roof and the parapet wall.

| Reference Numerals In Drawings: | |
|---|---|
| 10 | roof fin |
| 12 | anti-capillary groove |
| 14 | gutter wall |
| 16 | gutter floor |
| 18 | gutter wall |
| 20 | end wall |
| 22 | upper flange |
| 24 | lower flange |
| 26 | drain port aperture |
| 26-a | downwardly directed drain port flange |

-continued

| Reference Numerals In Drawings: | |
|---|---|
| 28 | soupper |
| 30 | roof sub-struc. (bldg) |
| 32 | roof top (bldg) |
| 34 | parapet (bldg) |
| 36 ' | parapet flashing |
| 40 | heating element |

DESCRIPTION OF PREFERRED EMBODIMENTS

Figure 2:
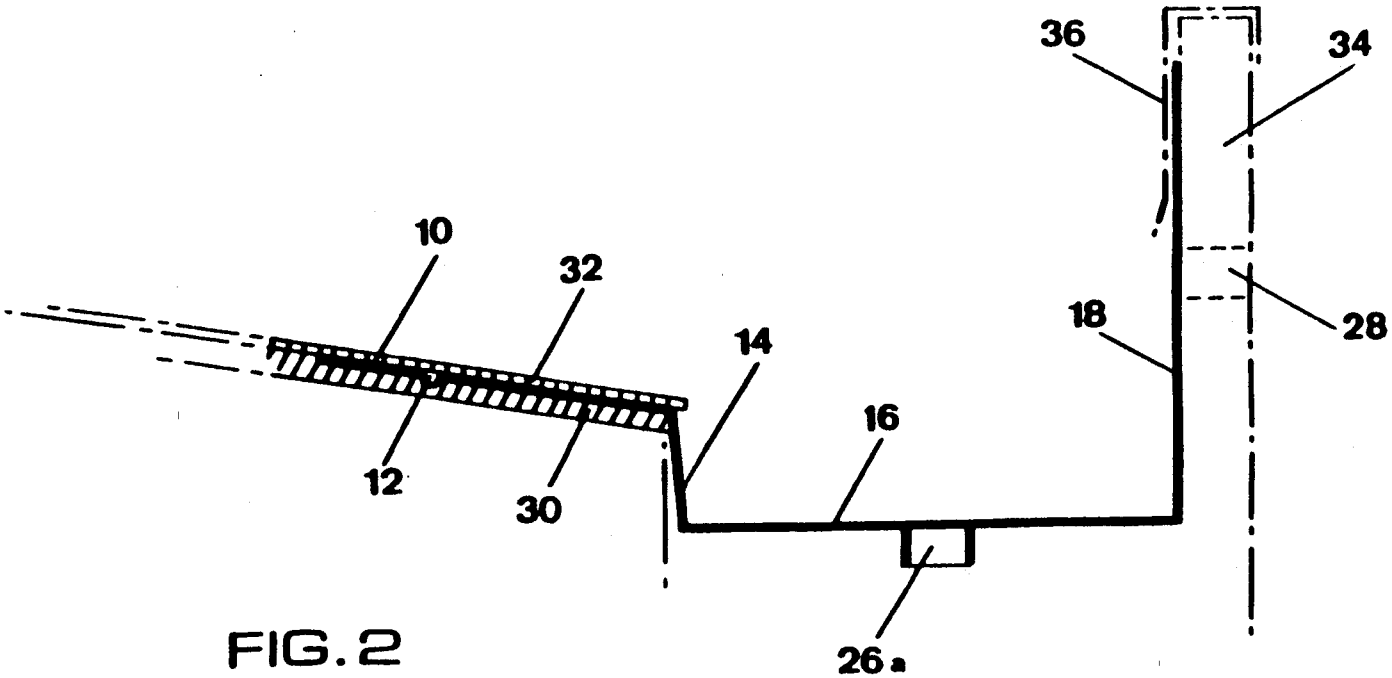
FIG. 2 is a sectional view showing the gutter interface with the roof and the parapet wall.

Referring to the drawings, FIGS. 1, and 2, which illustrate a modular gutter system as it relates to large non-residential buildings. The gutter assembly is comprised of a plurality of independent, elongated, monolithic, trough-like modules. Each module consists of two elongated sidewalls, two endwalls, a solid floor, and open top. The modules are preferably composed of non-metallic plastics, such as those characterized by fiberglass reinforced polyester. Each module presents itself as a seamless, watertight vessel. FIG. 2 shows an integral fin 10 diverging upwardly and outwardly from one of the elongated sidewalls. This fin is positioned on top of the roof substrate 30, and under the topmost roof membrane 32. To prevent water migration under the roof, the integral fin 10 incorporates a depressed groove 12 on the fin top plane for its full length. The depressed groove 12 prevents capillary attraction water migration under the roof membrane.

Figure 3:
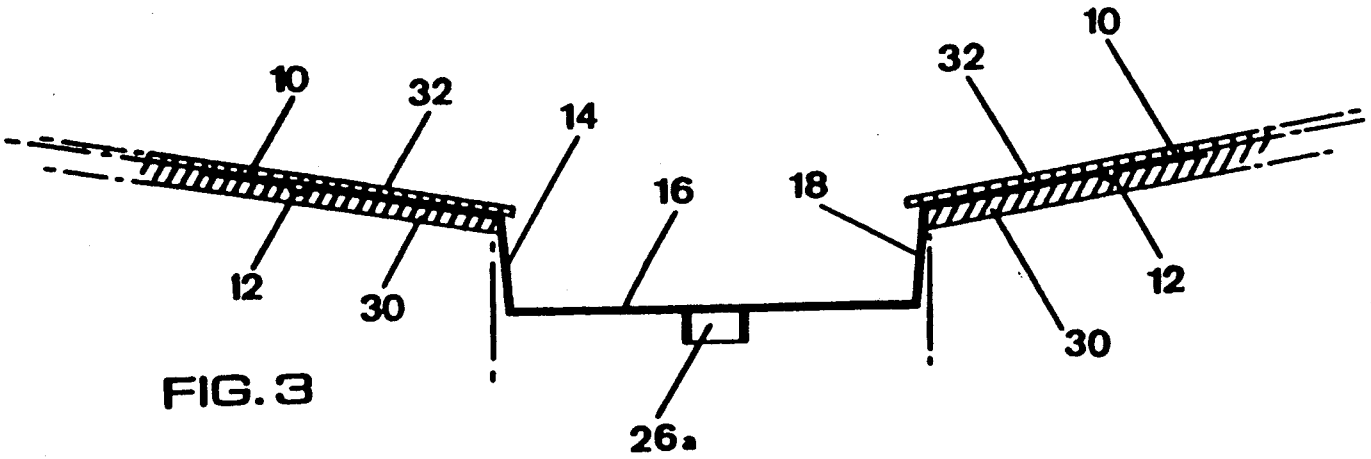
FIG. 3 is a sectional view of an alternate embodiment as it relates to a valley condition.

Sidewalls 14, 18 and solid floor 16, as well as fin 10, constitute the gutter profile which is continuous and unchanged for its full longitudinal body. Said sidewall 18, in FIG. 3, is extended vertically above the elevation of the top of endwalls 20. The extended sidewall provides for attachment to, and counter-flashing 36 for, the building parapet wall 34. FIG. 1 shows that endwalls 20 incorporate complementary and inter-engaging upper and lower flanges 22 and 24. A waterproof connection at adjacent module endwalls is thereby achieved. This non-impinging interface of independent gutter modules compensate axial expansion and contraction forces. Thereby, these expansion/contraction tolerances are present in individual modules lengths up to thirty feet or more.

The solid floor 16 presents a predetermined angle of incline from a high longitudinal mid-point, downwardly to the floor drain ports 26. The floor drain ports 26 are located in close proximity to each endwall 20. The drain ports 26 are subsequently at the lowest points of the floor elevation. The drain ports 26 are flanged downwardly and the flanges 26—a act as male connector to a female leader fitting. A scupper overflow aperture 28 is shown to present an aligned interface through the building parapet wall 34. This scupper overflow aperture 28 prevents the flooding of the module, primarily in the event of a blocked leader system or extreme storm loads.

FIG. 1 illustrates electrically energized unitary heating cable 40 internally embodied in the module floor 16. The cable pattern is predetermined by design to provide heat transference to the entire module floor surface. The encapsulation of the heating cable 40, assures unimpeded water flow while preventing ice formation.

ANOTHER EMBODIMENT

FIG. 3 shows a variant embodiment, which is essentially the same as that previously described and illustrated in FIGS. 1 and 2. This variant differs only in the reconfiguration of sidewall 18 to now duplicate fin 10, thereby presenting a symmetrical cross-section. This reconfiguration allows the application of the present invention to a valley condition; a condition wherein two downwardly sloped roof planes converge at a common low elevation.

Although two embodiments of the invention have been described and illustrated, it will be understood that obvious changes may be made within the scope of the following claims without departing from the spirit of my invention.

SUMMARY, RAMIFICATIONS, AND SCOPE

My novel gutter system teaches the means and methods of collecting and disposing stormwater from the roofs of large non-residential buildings by utilizing a plurality of independent, trough-like, monolithic gutter modules. When interfaced in tandem, in a non-impinging communication, critical expansion and contraction stresses are overcome. These expansion/contraction tolerances are present in individual modules lengths of up to thirty feet or more. The exclusive use of fiberglass reinforced polyester achieves and preserves the structural integrity to accommodate all imposed loads.

System blockage, as a result of ice formation in freezing climates, is prevented by a sealed homogeneously encased electrically energized heating cable. The present invention is compatible with all building design configurations, and with all of the various building materials with which it has contiguous interfacing.

Although the description above presents novel development, it should not be construed as limiting the scope of the invention, but as merely illustrating some of the recently preferred embodiments of this invention.

What I claim is:

1. A roof gutter assembly, rigidly formed and connected on all sides, comprising a plurality of structurally rigid, independent, elongated, monolithic, seamless, watertight, trough-like modules, formed of fiberglass reinforced polyester, each of said modules having first and second longitudinal sidewalls, a pair of end walls, a solid floor, and an open top said first sidewall having a scupper overflow aperture, said second sidewall being provided with an integral fin having a depressed groove, said solid floor being provided with an integrally encased heating element, and said solid floor being formed with at least two drain ports, whereby said drain ports are positioned in close proximity to said endwalls.

2. The roof gutter assembly of claim 1, wherein said first sidewall extends vertically to an elevation extending above the top of said endwalls, the full length of said first sidewall, and thereby providing attachment for flashing means to a building parapet wall.

3. The roof gutter assembly of claim 2 whereby said scupper overflow aperture is positioned at a substantially centered vertical mid-point of said first sidewall, said scupper overflow aperture being positioned in line with a matching aperture in said building parapet wall, thereby providing emergency flooding relief means to said roof gutter assembly.

4. The roof gutter assembly of claim 2 whereby said fin extends and diverges outwardly and upwardly along the full length of said second sidewall, said fin thereby providing attachment for flashing means against water migration.

5. The roof gutter assembly of claim 4 wherein said fin disposes said depressed groove on its top plane and along its full length, said depressed groove thereby providing anti-capillary attraction means against water migration.

6. The roof gutter assembly of claim 1 wherein said drain ports are homogeneously integrated with said solid floor, said drain ports present downwardly directed flanges, said downwardly directed flanges are complementarialy shaped so as to provide connection means to drain leaders.

7. The roof gutter assembly of claim 1 wherein said endwalls having a top edge and interengaging flanges extending the full length of each top edge, said interengaging flanges thereby providing non-impinging connection means for said endwalls of adjacent module, thereby providing axial stress compensation means to said gutter assembly.

8. The roof gutter assembly of claim 1 wherein said modules are configured with an angle of flair-out of said second sidewall and said endwalls, whereby the distance between said first and second sidewalls is smaller at the floor than at the top, said angle of flair-out thereby providing means of partial nesting of multiple units within one another during storage and shipping.

9. The roof gutter assembly of claim 1 wherein an electrically energized unitary heating element cable is disposed as an encased internal embodiment in said solid floor, said cable being positioned in a predetermined pattern, whereby heat transference means is presented to the entire floor.

* * * * *